US008622484B2

(12) United States Patent
Charlton

(10) Patent No.: US 8,622,484 B2
(45) Date of Patent: Jan. 7, 2014

(54) MOUNTING FOR A REPLACEABLE TOOL

(75) Inventor: Mitchell B. Charlton, Wallsend (AU)

(73) Assignee: Bradken Resources PTY Limited, Mayfield West, NSW (AU)

( * ) Notice: Subject to any disclaimer, the term of this patent is extended or adjusted under 35 U.S.C. 154(b) by 135 days.

(21) Appl. No.: 13/128,221

(22) PCT Filed: Nov. 6, 2009

(86) PCT No.: PCT/AU2009/001447

§ 371 (c)(1),
(2), (4) Date: Jul. 21, 2011

(87) PCT Pub. No.: WO2010/051593

PCT Pub. Date: May 14, 2010

(65) Prior Publication Data

US 2011/0266860 A1 Nov. 3, 2011

(30) Foreign Application Priority Data

Nov. 7, 2008 (AU) ..... 2008905769

(51) Int. Cl.
*E21C 35/19* (2006.01)
*E21C 35/197* (2006.01)

(52) U.S. Cl.
USPC ..... 299/106; 299/110

(58) Field of Classification Search
USPC ..... 299/102–104, 106–110, 112 R
See application file for complete search history.

(56) References Cited

U.S. PATENT DOCUMENTS

| | | | | |
|---|---|---|---|---|
| 3,397,012 | A * | 8/1968 | Krekeler | 299/104 |
| 3,967,399 | A | 7/1976 | Heinold et al. | |
| 4,343,516 | A | 8/1982 | Aden | |
| 5,029,944 | A | 7/1991 | Komotzki | |
| 5,040,850 | A | 8/1991 | Komotzki | |
| 5,067,775 | A | 11/1991 | D'Angelo | |
| 5,106,166 | A | 4/1992 | O'Neill | |
| 5,374,111 | A * | 12/1994 | Den Besten et al. | 299/106 |
| 6,086,160 | A * | 7/2000 | Bitelli | 299/104 |
| 6,854,810 | B2 * | 2/2005 | Montgomery, Jr. | 299/106 |
| 7,401,862 | B2 | 7/2008 | Holl et al. | |
| 7,537,288 | B2 * | 5/2009 | Chiang | 299/102 |
| 2008/0093912 | A1 * | 4/2008 | Willoughby | 299/107 |

FOREIGN PATENT DOCUMENTS

| | | | |
|---|---|---|---|
| DE | 3909425 C1 * | 8/1990 | E21C 25/42 |
| RU | 2332538 | 8/2008 | |
| SU | 281350 | 9/1970 | |

OTHER PUBLICATIONS

Decision on Grant Patent for Invention dated Sep. 4, 2012, directed to Russian Application No. 2011122822; 15 pages.

International Search Report and Written Opinion mailed Dec. 10, 2009, directed to counterpart International Patent Application No. PCT/AU2009/001447; 14 pages.

* cited by examiner

*Primary Examiner* — David Bagnell
*Assistant Examiner* — Michael Goodwin
(74) *Attorney, Agent, or Firm* — Morrison & Foerster LLP

(57) ABSTRACT

A mounting for a replaceable tool on a ground-engaging machine, the mounting having a tool holder having an aperture extending into a body portion of the tool holder for receiving a projecting mounting portion of the tool, the tool holder having an inter-engagement structure for mechanically engaging with a base having a complementary structure, the base being adapted to be fixed to the machine, and the mounting further having retaining means for cooperating with the holder and the tool when installed to retain the holder on the base.

16 Claims, 5 Drawing Sheets

MOUNTING FOR A REPLACEABLE TOOL

CROSS-REFERENCE TO RELATED APPLICATIONS

This application is a national stage application under 35 USC 371 of International Application No. PCT/AU2009/001447, filed Nov. 6, 2009, which claims the priority of Australian Application No. 2008-905769, filed Nov. 7, 2008, the contents of which prior applications are incorporated herein by reference.

FIELD OF THE INVENTION

The present invention relates to a mounting for a replaceable tool as well as mounted replaceable tools and methods of operation of machines such as ground-engaging or surface mining machines. An example of surface mining machines concerns such machines typically having rotating drums with projecting replaceable picks which are operated to break-up and convey ore at a mining location for collection into trucks.

BACKGROUND OF THE INVENTION

The invention is not confined to arrangements applicable only to such surface mining machines but the application to these machines will be given by way of example.

Typically a surface mining machine has a rotatable drum having pick holders welded to the drum periphery at spaced locations and each adapted to receive a replaceable pick. The pick typically has a bulbous head with hard-surfacing and a cylindrical mounting shaft which is intended to be a sliding fit in a receiving aperture in a pick holder. A spring clip surrounds a reduced diameter mid-portion of the shaft and resiliently retains the pick in the holder. In one arrangement the pick is designed to rotate in use but, due to the ingress of particulate material and general wear and tear, such rotation may cease thereby causing accelerated wear to the pick and also the holder.

Whereas the pick is typically installed with a suitable mallet, it is arranged to be removed by pressure to a rear end-face of the shaft applied through a jack. Due to wear and tear, removal may be problematic.

Since such surface mining machines represent a very high capital investment, machine downtime for servicing of worn parts is a critical economic factor. It has been found that typically the tool holders will need regular replacement and typically the tool holders are welded to the drum and have angled apertures relative the drum radial direction for mounting the shaft of a pick. The downtime required to cut-off worn tool holders and weld on replacement holders is considerable and requires significant on-site skill and appropriate equipment.

SUMMARY OF THE INVENTION

The present invention is directed to providing a system which is aimed at reducing downtime for replacing worn components and may be implemented in various embodiments offering various advantages. Whereas one embodiment is to suit surface mining machines as described above, other embodiments can suit other machines and other pick or tool designs.

In one aspect the invention consists in a mounting for a replaceable tool on a ground-engaging machine, the mounting having a tool holder having an aperture extending into a body portion of the tool holder for receiving a projecting mounting portion of the tool, the tool holder having an inter-engagement structure for mechanically engaging with a base having a complementary structure, the base being adapted to be fixed to the machine, and the mounting further having retaining means for cooperating with the holder and the tool when installed to retain the holder on the base.

In some embodiments, the tool is designed to rotate about the axis of the projecting mounting portion and the aperture is of circular cross-section and is such that the tool can normally rotate.

In some embodiments the retainer is adapted to interengage with the base in addition to the holder and the tool.

The invention may also be defined as subsisting in the tool holder with its retainer and the base and may further extend to the combination of components when the tool is installed. Thus in another aspect, the invention consists in a tool mount for use on a ground engaging machine, the tool mount comprising a tool, a tool holder, a retainer and a base, the base being adapted to be secured to a ground engaging machine adapted to rotate about its axis, the tool having an axis substantially parallel to the axis of the machine, the tool holder having an aperture therethrough for receiving a projecting shaft portion of the tool for mounting the tool and the tool holder having a shaped body portion adapted to interengage in a correspondingly shaped body portion of the base whereby the tool holder is movable in the axial direction but restrained from movement transverse to the axial direction by the retainer when installed, the tool holder having a portion for receiving the retainer, the retainer having a recess for receiving therein an end portion of the projection from the tool and the tool thereby being mounted to be rotatable around the axis but normally to be retained in engagement in the aperture and the recess, the retainer further having an inter-engagement structure for engaging with a complementary inter-engagement structure of the base and of the tool holder whereby the tool holder is restrained from axial movement upon installation of the retainer, the retainer, tool holder and base cooperating to define a recess defined between an axially facing end wall of the base whereby a pressure exerting element can be inserted into the recess between the end wall and the end of the projection shaft of the tool so that, on activation the pressure exerting element, the tool is axially displaced out of engagement with the retainer and the tool holder, whereby the tool may be replaced after a period of servicing when it is worn and thereby as necessary permitting a removal of the retainer and tool holder and their replacement if desired.

Conveniently the wear tool can be in the form of a bulbous hard-surfaced head and a mounting shaft of circular cross-section adapted to be push-fitted into a corresponding aperture extending through the holder with a friction arrangement to permit the shaft to rotate relative to the holder but to be retained in the holder in a manner removable by the application of axial force on the shaft through a suitable tool.

In another aspect, broadly the invention is directed to a method of operating a ground-engaging machine comprising fixing a base as described in the first aspect of the invention above to an element of the machine which is to be moved when used, fixing a tool holder on the base by inter-engaging of complementary parts and using a retainer and a tool to cooperate with the holder to secure the holder on the base and thereby mount the tool for operational use, and periodically replacing each tool and as required the corresponding holder and, if required, the associated retainer.

An important embodiment of the invention may be defined as consisting in a mounting for a replaceable tool on a ground engaging machine, the mounting having a base to be attached to the machine and profiled for inter-fitting with a tool holder having an aperture for receiving a projecting mounting portion of the tool and extending along the axis of the mounting portion and away from a ground-engaging head; the base having engagement elements for interengagement under by relative movement in a direction along the axis, with a tool holder which is arranged to receive a retainer inserted into a transverse direction to the axis, the base having interengagement means to co-operate with corresponding elements of the retainer to prevent relative movement in an axial direction.

The holder may be arranged to be installed on the base by motion in a direction parallel to the axis of the aperture (in which the tool projection i to extend) and the retainer may be configured to be installed in a direction normal to the axis to align its recess with the aperture of the holder whereby, when the tool is installed, its projection extends through the aperture and the recess and the engagement elements respectively of the holder and the base resist lateral relative displacement transverse to the defined axis and the cooperating further engagement elements of the retainer and the base prevent relative motion parallel with the axis.

The retainer and the base may be profiled to provide a part cylindrical cavity having an end-wall spaced from and confronting an end-face of the projection of the tool when installed, whereby a jack may be inserted to provide pressure to remove a worn tool and to permit its replacement.

The arrangement in a preferred embodiment is that once the tool has been removed, no more than simple hand tools are needed to eject the retainer from its installed position thereby permitting simple removal of the holder.

Embodiments of the invention lend themselves to a simple and speedy replacement of worn components and in particular, a replaceable tool holder. By having a component separate from the base and retained by a simple retainer, various advantages can be achieved. For example, different metals may be used for different components and if desired, for example, the holder could have its aperture defined by a specially selected metal sleeve for wear resistant purposes. These factors will be appreciated to have great significance when the harsh environment of the mining operation is considered with wear and tear caused by vibration, corrosion, impact and ingress of fine particles.

BRIEF DESCRIPTION OF THE DRAWINGS

The invention will now be exemplified with reference to the embodiment disclosed in the accompanying drawings of which.

DETAILED DESCRIPTION OF THE INVENTION

Figure 1:
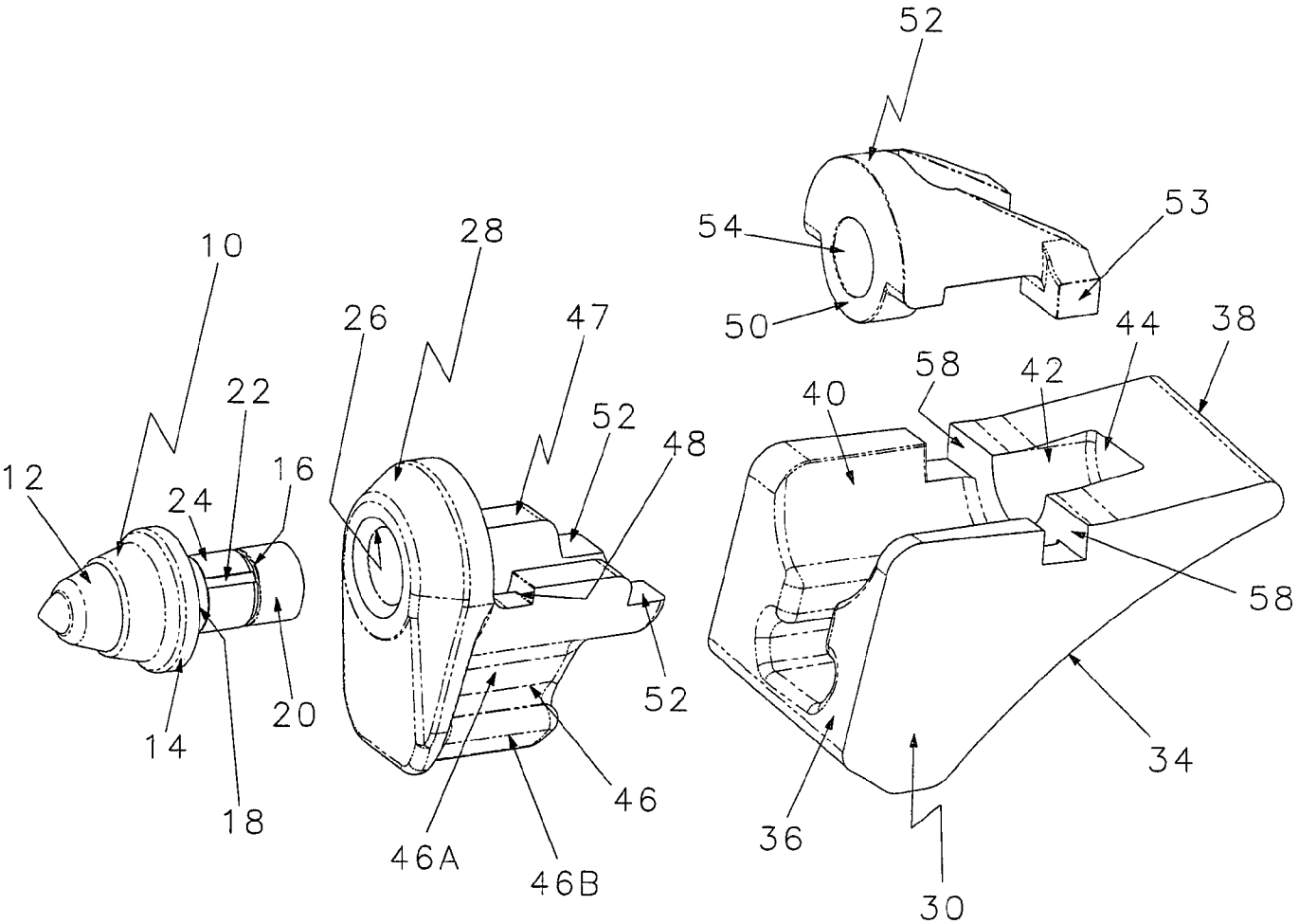
FIG. 1 is an exploded perspective view from the front of the embodiment.
Figure 2:
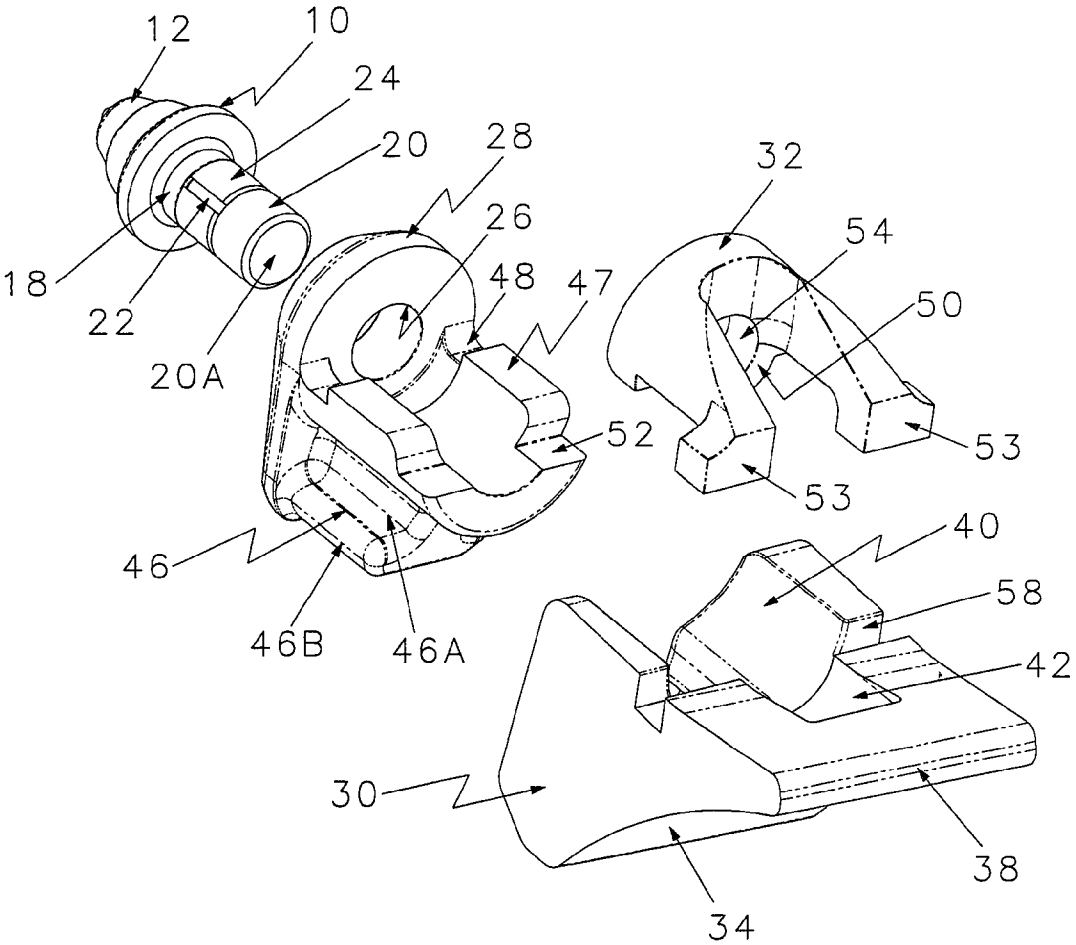
FIG. 2 is an exploded perspective view from the rear.
Figure 4:
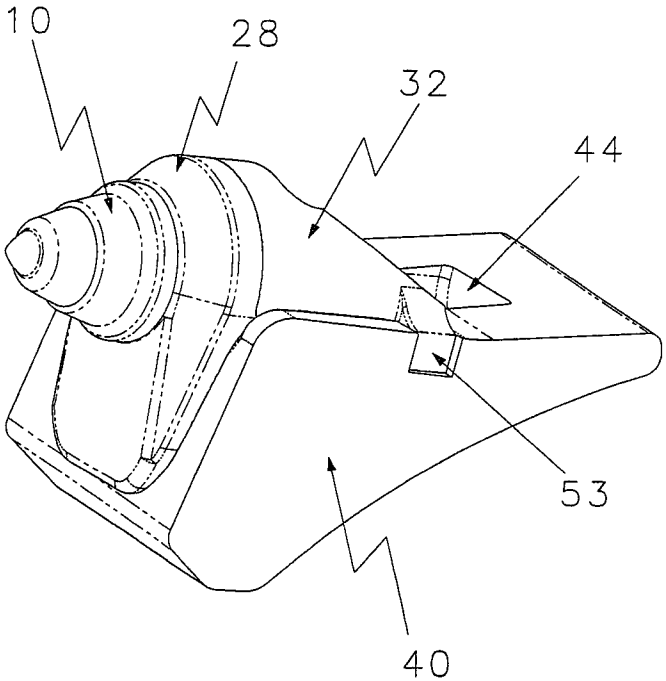
FIG. 4 is an assembled perspective view from the front of the arrangement shown in FIG. 3.
Figure 3:
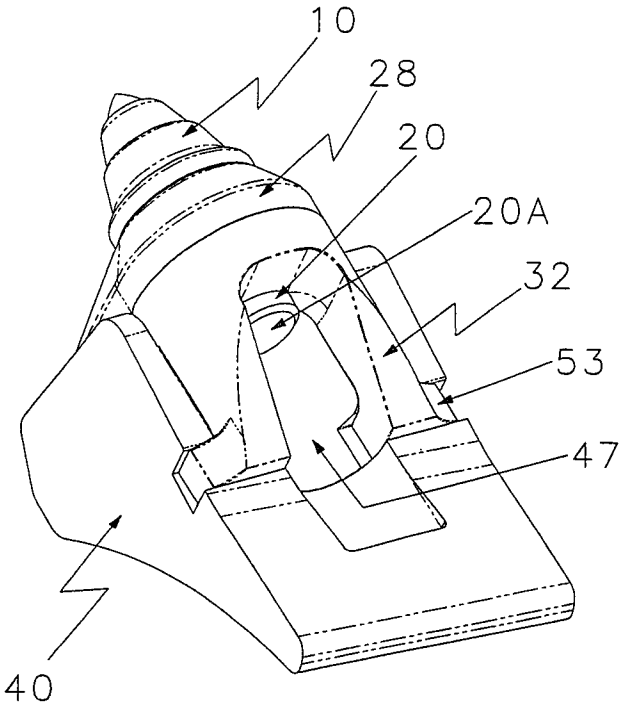
FIG. 3 is an assembled view of the embodiment of FIGS. 1 and 2 being a perspective view generally from the rear.
Figure 6:
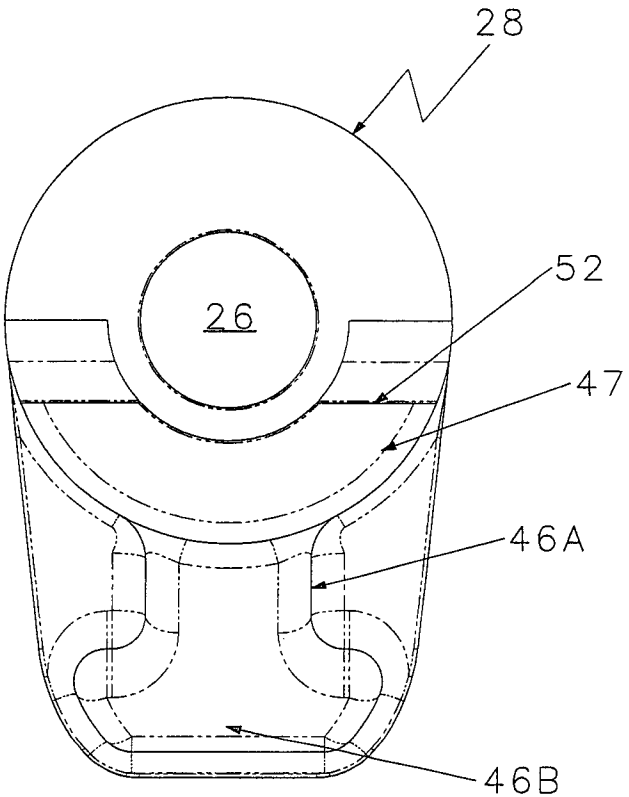
FIG. 6 is a rear view of FIG. 5.
Figure 5:
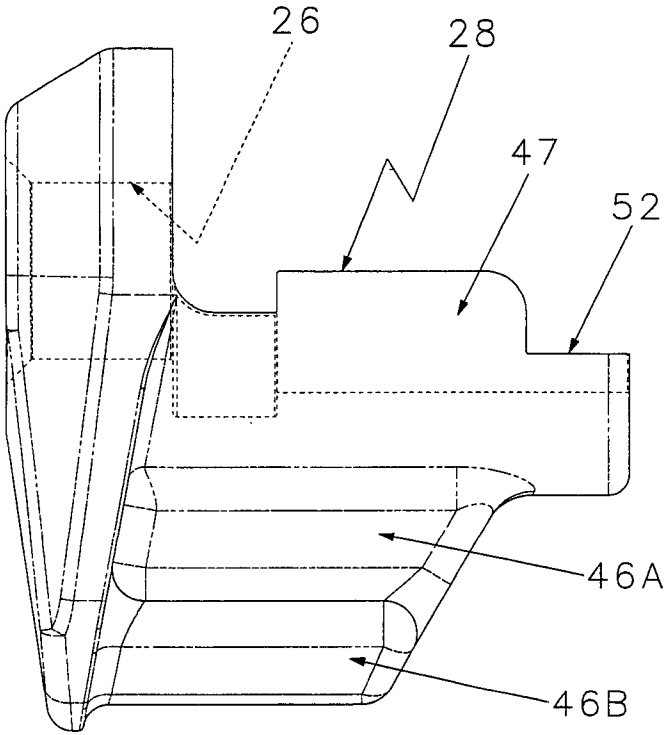
FIG. 5 is a side elevation of the assembled embodiment of FIGS. 3 and 4.

The embodiment of the drawings is adapted to be mounted on a cylindrical drum of a surface mining machine where the ore to be broken up is engaged by suitable tools having a hard faced surface such as the tools in the form of a pick 10 shown in the drawings. The illustrated pick is known in the present art and comprises a head 12 having a hard facing, a base 14 and a mounting shaft 16 of circular cross section and comprising cylindrical front and rear shaft portions 18 and 20 with an intermediate shaft portion 22 of reduced diameter accommodating a spring steel circlip 24. The shaft 16 is a sliding fit in a cylindrical aperture 26 of a tool holder so that the shaft is rotatable within the aperture 26 yet the spring clip 24 frictionally retains the pick 10 from falling out of the aperture.

The tool holder 28 is adapted to be mounted on a base 30 and secured in position by a retainer 32 in combination with the shaft 16 of the pick. The base 30 has a cylindrically curved bottom surface 34 for engaging on the surface of a rotating drum of the ground mining machine and it is adapted to be welded thereto. The base 30 in the present embodiment is generally not susceptible to significant wear and therefore should have a long working life. The base 30 has front and rear walls 36 and 38 and a major cavity 40 for accommodating the tool holder 28 with, at the rear end, a half cylindrical rear cavity 42 having a transverse rear wall 44 for accommodating a pick ejection jack which operates between the wall 44 and the confronting rear face 20A of the rear shaft portion 20 of the pick 10.

Figure 7:
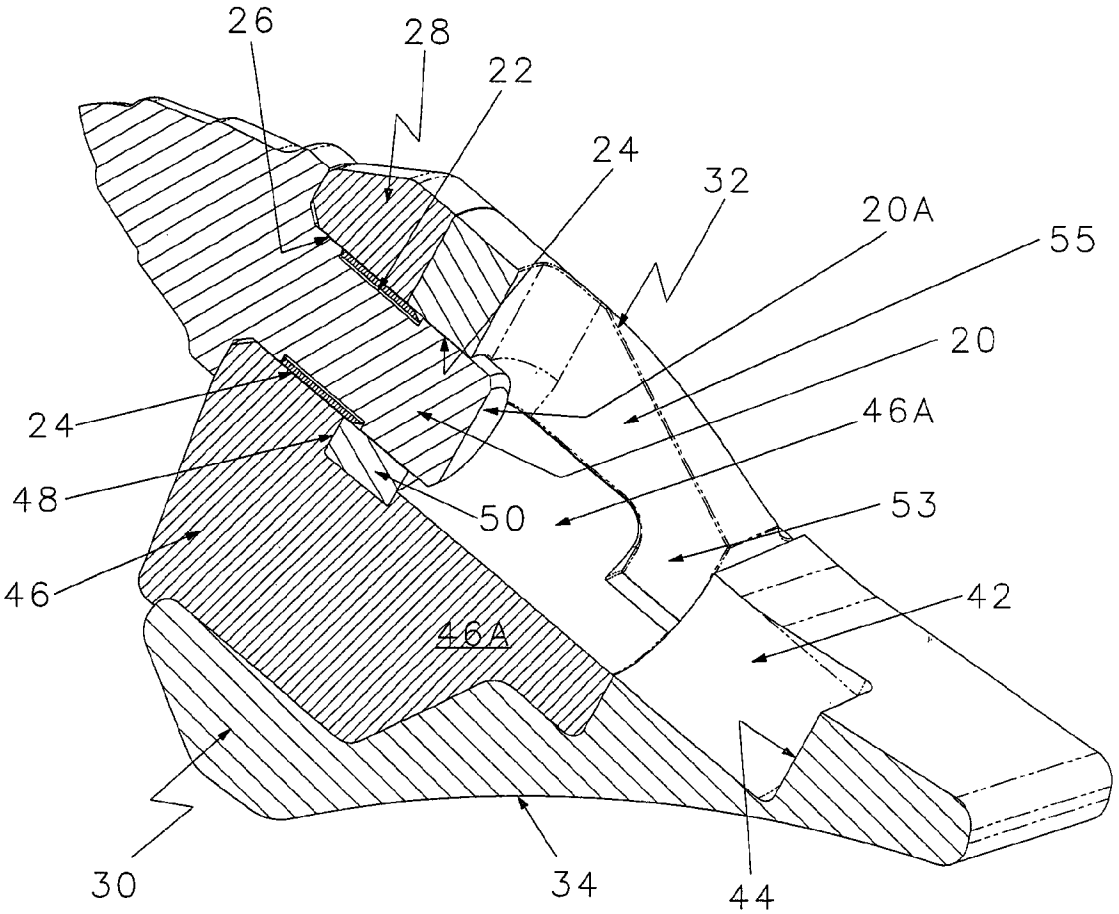
FIG. 7 is an axial cross-sectional side view of the embodiment of FIGS. 3 and 6 when assembled.

FIG. 7 shows more clearly the lower portion of the cavity 40 which accommodates a generally T-shaped base portion 46 of the tool holder 28. The base portion 46 comprises a reduced-thickness intermediate portion 46A and a curved T-shaped head 46B. As well shown in FIG. 1, the tool holder has an upper cradle-shaped extension 47 with a rearward extension providing on each side, a shouldered recess 52 for accommodating respective engagement feet 53 of the retainer 32, which has inner faces 55 contoured to match the cylindrical profile of the cradle-shaped portion 47.

The retainer 32 has a circular cross-sectional aperture 54 in which the shaft portion 20 is a sliding fit, but can rotate with the spring clip 24 also retaining the shaft portion in the retainer as shown in FIG. 7.

When the base 30 is welded to the drum of the machine, a pick 10 can readily be installed by firstly displacing the tool holder 28 axially relative to its aperture 26 so that the cradle 47 and base portion 46 securely engage in a complimentary structure of the base, thereby preventing the holder 28 moving normal to the axis.

When the retainer 32 is installed, the feet 53 engage in corresponding slots 58 in the side walls of the base 30 and the arcuate front engagement element 50 of the retainer 32 engages into corresponding side slots 48 in the tool holder 28. Thus there is restriction to axial movement of the parts relative to one another. Finally inter engagement is achieved by insertion of the shaft 16 of the pick 10 through the aperture 26 in the holder 28 and through the aperture 54 in the retainer 32. Thus the components are held relative to one another.

However, disassembly and replacement of worn parts (typically the pick 10 and the holder 28) can be easily accomplished by inserting a screw jack between an end face 20A of the shaft 16 and the transverse rear wall 44 in the base. Activation of the screw jack presses the pick axially and outwardly.

Plainly different materials can readily be used for the different components. The base 30 needs to be of a weldable grade of steel but other grades can be used for the other components. For example white iron might be used for the tool holder 28 so it may have great durability and resistance to wear.

The invention claimed is:

1. A tool mount for use on a ground engaging machine, the tool mount comprising a tool, a tool holder, a retainer and a base, the base being adapted to be secured to a ground engaging machine adapted to rotate about its axis, the tool having an axis substantially perpendicular to the axis of the machine, the tool holder having an aperture therethrough for receiving a projecting shaft portion of the tool for mounting the tool and the tool holder having a shaped body portion adapted to interengage in a correspondingly shaped body portion of the base whereby the tool holder is movable in the direction of the tool axis but restrained from movement transverse to the tool axis by the base when installed, the tool holder having a portion for receiving the retainer, the retainer having a recess for receiving therein an end portion of the projecting shaft portion of the tool and the tool thereby being mounted to be rotatable around the tool axis but normally to be retained in engagement in the aperture and the recess, the retainer further having an inter-engagement structure for engaging with a complementary inter-engagement structure of the base and of the tool holder whereby the tool holder is restrained from movement along the tool axis upon installation of the retainer, the retainer, tool holder and base cooperating to define a recess defined between an axially facing end wall of the base and the end of the projection shaft of the tool whereby a pressure exerting element can be inserted into the recess between the end wall and the end of the projection shaft of the tool so that, upon activation of the pressure exerting element, the tool is axially displaced out of engagement with the retainer and the tool holder, whereby the tool may be replaced after a period of servicing when it is worn and thereby as necessary permitting a removal of the retainer and tool holder and their replacement if desired, and wherein the aperture in the tool holder has a circular cross-section and extends through a head of the tool holder for mounting the shaft of the tool, and a cradle shaped portion extending axially from the head for receiving the retainer, the tool holder having a T-shaped base with a reduced thickness portion being adjacent to the cradle portion, the T-shaped base being slidingly engagable in a corresponding recess in the base, the tool holder further comprising a recess in at least one upper edge portion of the cradle portion and the retainer has a corresponding lug to engage in the recess to prevent relative axial movement.

2. The tool mount according to claim 1, wherein the base has an engagement structure and the retainer has a corresponding engagement structure for interengagement to restrain relative axial movement, and whereby when the recess in the retainer accommodates the end portion of a shaft of the tool, the retainer is restrained from relative motion transverse to the axis.

3. A mounting for a replaceable tool on a ground-engaging machine, the mounting having a tool holder having an aperture extending into a body portion of the tool holder for receiving a projecting mounting portion of the tool, the tool holder having an inter-engagement structure for mechanically engaging with a base having a complementary structure, the base being adapted to be fixed to the machine, and the mounting further having a retainer comprising an interengaging structure for cooperating with the holder and the base when in an installed position to retain the holder on the base, the retainer further comprising a recess for receiving therein the mounting portion of the tool and the tool is able to be mounted so as to be retained in engagement in the aperture and the recess, and when so mounted, the tool prevents the retainer from being removed from its installed position.

4. The mounting according to claim 3, wherein the aperture is of circular cross-section for receiving axially the projecting shaft portion of the tool to mount it for rotation about the axis of the aperture, the projecting shaft portion being correspondingly shaped to the aperture.

5. A tool mount for use on a ground engaging machine, the tool mount comprising a tool, a tool holder, a retainer and a base;

the base being adapted to be secured to a ground engaging machine;

the tool having a projecting shaft portion;

the tool holder having an aperture therethrough for receiving the tool shaft portion, a shaped body portion adapted to interengage in a correspondingly shaped body portion of the base in an installed position, and a portion for receiving the retainer whereby the tool holder is movable in a first direction but restrained from movement transverse to the first direction by the base when in the installed position;

the retainer having a recess for receiving therein an end portion of the tool shaft portion and an inter-engagement structure for engaging with a complementary inter-engagement structure of the base and of the tool holder in an installed position;

wherein when the tool holder and the retainer are in their installed positions, the tool is able to be mounted so as to be retained in engagement in the aperture and the recess, and when so mounted, the tool prevents the retainer from being removed from its installed position, the tool being displaceable out of engagement with the retainer and the tool holder permitting removal of the retainer and tool holder.

6. The tool mount according to claim 5, wherein the retainer, tool holder and base cooperate to define a recess defined between an axially facing end wall of the base and the end of the tool shaft portion whereby a pressure exerting element can be inserted into the recess between the end wall and the end of the tool shaft portion so that, upon activation of the pressure exerting element, the tool is displaceable out of engagement with the retainer and the tool holder.

7. The tool mount according to claim 6, wherein the tool has an axis about which it is rotatable when mounted in engagement with the retainer and the tool holder.

8. The tool mount according to claim 7, wherein the first direction is in the direction of the tool axis.

9. The tool mount according to claim 5, wherein the retainer is movable into and out of its installed position by movement in a second direction transverse to the first direction.

10. The tool mount according to claim 5, wherein the inter-engagement structure of the retainer and the complementary inter-engagement structure of the base and of the tool holder are in the form of interfitting projections and recesses.

11. The tool mount according to claim 5, wherein the tool holder includes a head through which the aperture extends and a cradle shaped portion extending from the head for receiving the retainer.

12. The tool mount according to claim 11, wherein the tool holder has a recess in at least one upper edge portion of the cradle-shaped portion which forms at least part of the complementary inter-engagement structure of the tool holder and the retainer has a corresponding lug to engage in the recess and which forms part of the inter-engagement structure of the retainer.

13. The tool mount according to claim 12, wherein the base further comprises one or more recesses in an upper edge portion thereof which forms at least part of the complementary inter-engagement structure of the base, the retainer having at least one foot spaced from the lug to engage in the one or more recesses in the base and which forms part of the inter-engagement structure of the retainer.

14. The tool mount according to claim 5, wherein the shaped body portion of the tool holder is a T-shaped base with a reduced thickness portion to be slidingly engaged in a corresponding recess in the base.

15. The tool mount according to claim 6, wherein the recess in the retainer is in the form of an aperture.

16. A mounting for mounting a tool to a base on a ground engaging machine, the mounting comprising:

a tool holder having a body portion incorporating an aperture and a first inter-engagement structure for engaging with the base in an installed position, the mounting being moveable relative to the base from the installed position to a released position; and a retainer having a recess and a second inter-engagement section for engaging with both the tool holder and the base in an installed position wherein the retainer prevents movement of the holder relative to the base from its installed position to its released position;

wherein when the tool holder and the retainer are in their respective installed positions, the aperture and the recess are aligned and arranged to form a receiving passage to receive the tool so as to mount the tool to the base and wherein when so mounted, the retainer is retained in its installed position by the tool.

* * * * *